US006264588B1

(12) United States Patent
Ellis

(10) Patent No.: US 6,264,588 B1
(45) Date of Patent: Jul. 24, 2001

(54) COMPOSITE MOTION MACHINE

(76) Inventor: Joseph K. Ellis, 1561 Sundale Dr., Lawrenceville, GA (US) 30045

( * ) Notice: Subject to any disclaimer, the term of this patent is extended or adjusted under 35 U.S.C. 154(b) by 0 days.

(21) Appl. No.: 09/488,688

(22) Filed: Jan. 20, 2000

(51) Int. Cl.[7] ..... A63B 21/062; A63B 21/068
(52) U.S. Cl. ..... 482/137; 482/96; 482/100
(58) Field of Search ..... 482/137, 96, 100, 482/101, 134, 93, 72, 97–98, 94, 102, 103, 135, 136, 95, 99; 601/33–35, 98

(56) References Cited

U.S. PATENT DOCUMENTS

| | | |
|---|---|---|
| 4,149,714 | 4/1979 | Lambert, Jr. . |
| 4,828,254 | 5/1989 | Mang . |
| 5,106,080 | 4/1992 | Jones . |
| 5,125,881 | 6/1992 | Jones . |
| 5,135,449 | 8/1992 | Jones . |
| 5,366,432 | 11/1994 | Habing et al. . |
| 5,484,365 | 1/1996 | Jones et al. . |
| 5,554,084 | 9/1996 | Jones . |
| 5,554,086 | 9/1996 | Habing et al. . |
| 5,554,089 | 9/1996 | Jones . |
| 5,554,090 | 9/1996 | Jones . |
| 5,616,107 | 4/1997 | Simonson . |
| 5,620,402 | 4/1997 | Simonson . |
| 5,643,152 | 7/1997 | Simonson . |
| 5,795,270 | 8/1998 | Woods et al. . |
| 5,997,447 | 12/1999 | Giannelli et al. . |
| 6,010,437 | 1/2000 | Jones . |

OTHER PUBLICATIONS

Metal Resources, Inc. HQ Line color brochure.
Metal Resources, INc. HQ Line black & white brochure.

*Primary Examiner*—Stephen R. Crow
(74) *Attorney, Agent, or Firm*—Technoprop Colton LLC

(57) ABSTRACT

A composite motion movement machine combining a moving actuating member and a moving user support, the composite motion movement machine having a support member, a frame on which the user support is located, the frame being pivotally connected to the support member, a truck in slidable engagement with the support member and the frame, an actuating member being pivotally connected to the support member and operatively connected to the truck, the actuating member being adapted to move between a first position and a second position, and a linking mechanism operatively connecting said actuating member with said truck, wherein, when the user moves the actuating member between the first position and the second position, the truck moves along rails on the support member, forcing the frame to pivot relative to the support member and causing the user to actuate a resistance weight, thus exercising, strengthening or rehabilitating certain of the user's muscles.

17 Claims, 7 Drawing Sheets

COMPOSITE MOTION MACHINE

BACKGROUND OF THE INVENTION

1. Technical Field.

This invention relates to the general technical field of exercise and physical therapy equipment and machines and to the more specific novel technical field of a mechanically operated composite motion movement machine designed to provide a more biomechanically correct motion when operated by the user.

2. Prior Art.

Exercise and physical therapy equipment and machines are available in various configurations and for various purposes. Generally, such equipment and machines can be categorized into three broad categories: free weights, mechanically operated single action resistance machines, and electrically operated resistance machines. Mechanically operated single action resistance machines can be subcategorized into three broad categories: stack weight resistance operated, free weight resistance operated, and alternative resistance operated. Mechanically operated single action resistance machines are available for exercising, strengthening and rehabilitating various individual muscles, muscle groups, combinations of muscle groups, joints, and other parts of the body.

Exercise and physical therapy equipment and machines are available for all of the major muscle groups. The majority of such equipment and machines, especially in the exercise field, concentrate on areas of the body such as the legs, the hips and lower torso, the chest and upper torso, the back, the shoulders and the arms. A cross-section of such equipment and machines is discussed in the following paragraphs.

One type of machine for exercising and strengthening the leg muscles is commonly called a leg presses. There are two typical types of leg presses, both of which are single action. By single action, it is meant that either the push plate moves or the seat moves, but not both together, during the operative movement. The first typical leg press has a push plate that can move relative to a frame supporting a stationary seat or other user supporting means. The second typical leg press has a seat or other user supporting means that can move relative to a frame supporting a stationary push plate. Both types of leg presses can operate using a weight stack, free weights, user body weight or other resistance means to supply the desired amount of resistance for exercising the desired leg muscle or muscles.

In the first typical leg press, when the user pushes the push plate forward, the plate either travels on a linear path or, if hinged or pivoted, an arcuate path. Both linear and arcuate paths can induce incorrect biomechanical movement of the user's muscular-skeletal system, thereby causing undesirable stress in various areas of the user's body. In the second typical leg press, when the user pushes against the push plate, the seat or other user supporting means travels in a linear path. As already discussed, such a linear path can induce incorrect biomechanical movement of the user's body, resulting in undesirable stress in various areas of the user's body.

U.S. Pat. No. 4,149,714 to Lambert, Jr. discloses a seated weight lifting leg press exercise machine having a moving push plate and a stationary seat. Lambert '714 is a typical example of a mechanical leg press using weight stacks. The user sits on the seat, bends his knees and places his feet on the push plate, and pushes the push plate by straightening his legs. The push plate travels in an arcuate path and is mechanically connected to a weight stack that can be adjusted to a desired weight. A variable radius cam causes the resistance from the weights to increase during the latter phase of the exercise.

U.S. Pat. No. 4,828,254 to Maag discloses a crank and slider/four-bar variable resistance carriage-type leg press machine having a stationary push plate and a moving seat. Maag '254 is an atypical example of a mechanical leg press using free weights. The user stands on the push plate, bends her knees and places her back against a pad and her shoulders against shoulder pads, and pushes the shoulder pads by straightening her legs. The shoulder pads travel in a linear direction and are mechanically connected to a weight bar that can carry a desired amount of weight. A four-bar linkage causes the resistance from the weights to change during the course of the exercise.

U.S. Pat. No. 5,106,080 to Jones discloses a leg press exercise machine having a stationary seat and two moving push plates, one for each leg. Jones '080 is a typical example of a mechanical leg press using free weights. The user sits on the seat, bends his knees and places each of his feet on one of the push plates, and pushes each push plate by straightening his respective legs. The push plates travel in arcuate paths and each comprise a weight bar that can carry a desired amount of weight. Separate push plates allow independent exercise of each leg.

U.S. Pat. No. 5,366,432 to Habing et al. discloses a leg press having a stationary seat and a moving push plate. Habing '432 is a typical example of a mechanical leg press using a weight stack. The user sits on the seat, bends her knees and places her feet on the push plate, and pushes the push plate by straightening her legs. The push plate travels in a linear path and is mechanically connected to a weight stack that can be adjusted to a desired weight. A pulley and cable system causes the resistance from the weights to change during the course of the exercise.

U.S. Pat. No. 5,484,365 to Jones et al. discloses a leg press exercise machine having a stationary seat and a moving push plate. Jones '365 is another typical example of a mechanical leg press using a weight stack. The user sits on the seat, bends his knees and places his feet on the push plate, and pushes the push plate by straightening his legs. The push plate travels in an arcuate path and is mechanically connected to a weight stack that can be adjusted to a desired weight. A parallel link system, a pair of weight stacks and a counterweight cause the need for overhead connections between the push plate and the weight stack and eliminate the slack inherent in cable systems.

U.S. Pat. No. 5,554,086 to Habing et al. discloses a leg press exercise apparatus having a stationary push plate and a moving seat. Habing '086 is an atypical example of a mechanical leg press using a weight stack. The user sits on the seat, bends her knees and places her feet on the push plate, and pushes the seat by straightening her legs. The seat travels in an arcuate direction and is mechanically connected to a weight stack that can be adjusted to a desired weight. The Habing '086 device is intended to be an add-on feature for a multi-station exercise machine.

U.S. Pat. No. 5,554,090 to Jones discloses a calf exercise machine having a stationary seat and a moving push plate. Jones '090 is a typical example of a mechanical calf press using free weights. The user sits on the seat, places the balls of his feet on the push plate, and pushes the push plate by contracting his calf muscles. The push plate travels in an arcuate path and is mechanically connected to hubs on which varying amounts of free weights may be placed.

U.S. Pat. No. 5,616,107 to Simonson discloses a method and apparatus for leg press exercise with counterbalance having a stationary seat and a moving push plate. Simonson '107 is another typical example of a mechanical leg press using a weight stack. The user sits on the seat, bends his knees and places his feet on the push plate, and pushes the push plate by straightening his legs. The push plate travels in an arcuate path and is mechanically connected to a weight stack that can be adjusted to a desired weight. A counterweight counterbalances the inherent resistance of the leg press machine over the range of the exercise.

U.S. Pat. No. 5,795,270 to Woods et al. discloses a semi-recumbent arm and leg press and aerobic exercise apparatus having a stationary seat and a moving push plate. Woods '270 is an atypical example of a mechanical press using air resistance. The user sits on the seat, bends her knees and places her feet on the push plate, and pushes the push plate by straightening her legs. Air resistance means are mechanically coupled to the push plate and are actuated by pushing the push plate. The user continuously pushes and releases the push plate, achieving both leg press and aerobic exercise. A similar mechanism also is included for exercising the upper body.

Equipment and machines for exercising and strengthening the chest muscles commonly are called chest presses. There really is only one type of chest press, which is single action in that the actuating member moves relative to a frame supporting a stationary seat or other user supporting means. When the user pushes the actuating member forward, the actuating member either travels on a linear path or, if hinged or pivoted, an arcuate path. Both linear and arcuate paths can induce incorrect biomechanical movement of the user's muscular-skeletal system, thereby causing undesirable stress in various areas of the user's body.

U.S. Pat. No. 5,554,089 to Jones discloses a military press exercise machine having a stationary seat and moving actuating grips. Jones '089 is a typical example of a machine for exercising the chest and shoulder muscles using free weights. The user sits on the seat, grasps the actuating grips, and pushes the actuating grips. The actuating grips, which can be operated independently of each other, travel in arcuate paths and are mechanically connected to hubs on which varying amounts of free weights may be placed.

U.S. Pat. No. 5,643,152 to Simonson discloses a chest press exercise machine and method of exercising having a stationary seat and moving actuator grips. Simonson '152 is a typical example of a machine for exercising the chest muscles using a weight stack. The user sits on the seat, grasps the actuator grips, and pushes the actuator grips. The actuating grips travel in arcuate paths and are mechanically connected to a weight stack that can be adjusted to a desired weight.

U.S. Pat. No. 5,997,447 to Giannelli et al. discloses a chest press apparatus for exercising regions of the upper body having a stationary seat and moving actuator grips. Giannelli '447 is a typical example of a chest press using a weight stack. The user sits on the seat, grasps the actuator grips, and pushes the actuator grips. The actuating grips travel in an inward and arcuate path and are mechanically connected to a weight stack that can be adjusted to a desired weight.

Equipment and machines for exercising and strengthening the back muscles commonly are called back or lat machines. There also really is only one type of back or lat pull, which is single action in that the actuating member moves relative to a frame supporting a stationary seat or other user supporting means. When the user pulls the actuating member, the actuating member either travels on a linear path or, if hinged or pivoted, an arcuate path. Both linear and arcuate paths can induce incorrect biomechanical movement of the user's muscular-skeletal system, thereby causing undesirable stress in various areas of the user's body.

U.S. Pat. No. 5,135,449 to Jones discloses a rowing exercise machine having a stationary seat and moving actuating grips. Jones '449 is a typical example of a rowing machines for exercising the upper torso, specifically the back muscles, using free weights. The user sits on the seat, grasps the actuating grips, and pulls the actuating grips. The actuating grips, which can be operated independently of each other, travel in arcuate paths and are mechanically connected to hubs on which varying amounts of free weights may be placed.

U.S. Pat. No. 5,620,402 to Simonson discloses a rear deltoid and rowing exercise machine and method of exercising having a stationary seat and moving actuator grips. Simonson '402 is a typical example of a deltoid machine for exercising the back muscles using a weight stack. The user sits on the seat, grasps the actuator grips, and pulls the actuator grips. The actuating grips travel in a combined inward and arcuate path and are mechanically connected to a weight stack that can be adjusted to a desired weight.

There are other machines for exercising other parts of the torso, such as the abdominal muscles, or combinations of muscles.

U.S. Pat. No. 5,125,881 to Jones discloses a rear shoulder exercise machine having a stationary bench and moving actuating pads. Jones '881 is a typical example of a machine for exercising the back muscles using free weights. The user lies on the bench, engages the actuating pads, and pushes the actuating pads. The actuating pads, which can be operated independently of each other, travel in arcuate paths and are mechanically connected to hubs on which varying amounts of free weights may be placed.

U.S. Pat. No. 5,554,084 to Jones discloses an abdominal/hip flex exercise machine having a stationary seat and moving actuator pads. Jones '084 is a somewhat less typical example of an abdominal contraction machine using free weights. The user sits on the seat, engages the actuator pads with the lower arms, and pushes the actuator pads. The actuating pads travel in an arcuate path and are mechanically connected to hubs on which varying amounts of free weights may be placed.

U.S. Pat. No. 6,010,437 to Jones discloses a standing push/pull exercise machine having no user support and moving actuator grips. Jones '437 is a somewhat less typical example of a device for exercising the chest, back and torso muscles using free weights. The user stands in the proper position before the machine, grasps the actuator grips, and initiates a push/pull motion. One actuating pad is connected to a pull exerciser, and the other actuating pad is connected to a push exerciser. To achieve symmetrical exercises, two mirror image machines are necessary. The actuating pads travel in an arcuate path and are mechanically connected to hubs on which varying amounts of free weights may be placed.

The previously described art comprises a general cross-section of the exercise and physical therapy equipment and machine art as it is today. As can be seen, individual apparatuses have either a stationary user support and a moving actuating member or a moving user support and a stationary actuating member, but not a combination. Further, individual apparatuses have either a linear travel path or an arcuate travel path, but not a combination or a path that more closely resembles the actual biomechanical path of the human body in motion. Individual apparatuses also either use weight stacks, free weights, user body weight or air resistance, or other single resistance sources, and only a small number of apparatuses combine weight stacks or free weights with the user's body weight.

Thus it can be seen that a composite motion movement machine comprising a combination moving user support and moving actuating member, an improved travel path more closely resembling the actual biomechanical path of the human body in motion, and a combination resistance using weight stacks or free weights and the user's body weight would be useful, novel and not obvious, and a significant improvement over the prior art. Such a machine can be used as the basic operative mechanism on a wide variety of exercise and physical therapy equipment and machines. It is to such a composite motion movement machine that the current invention is directed.

BRIEF SUMMARY OF THE INVENTION

The present invention is a composite motion movement machine that comprises a composite motion movement in which both the user support and the actuating member move. In the preferred embodiment, the composite motion movement machine comprises both a moving user support and a moving actuating member. The user support is mounted on a frame that is pivotally connected to a support member and that rides upon a truck. The user support can be a pad or plate on which the user stands, a seat on which the user stands, sits or kneels, a recumbent seat, or a generally horizontal pad or plate on which the user lies supine or prone. The actuating member also is pivotally connected to the support member via a support bar that also is operatively coupled to the truck. The truck rides upon rails that are an integral part of the support member. The frame further may comprise or may be mechanically coupled to a supplemental weight resistance means.

The user support can optionally comprise adjustable shoulder pads, knee or leg braces, foot braces and/or hand grips that the user engages when operating the machine. In operation, the frame pivots generally in an arcuate path relative to the support member. Running along the length of the bottom side of the frame is one or more rail for engaging the truck. Supplemental weight resistance means can be coupled to the machine, preferably to the frame, to provide additional resistance weight.

The actuating member is located proximal to the frame and is pivotally coupled to the support member. Typically, the actuating member is coupled to the support member at a location proximal to where the frame is coupled to the support member. The actuating member further is operatively coupled to the truck. The actuating member pivots generally in an arcuate path relative to the support member. The actuating member can be adjustable relative to the user support based on the size of the user.

The support member generally is a component that lays flat on the floor or other supporting surface. The frame and actuating member are pivotally connected on or near a first side or edge of the support member. One or more rail for carrying the truck is or are located along a portion of the support member.

The truck is located between the frame and the support member and is slidably connected to both via the rails. The truck is a hinged component comprising a top portion pivotally hinged to a bottom portion. Top bearings located on the top portion of the truck cooperate with the rail or rails running along the bottom side of the frame, and bottom bearings located on the bottom portion of the truck cooperate with the rail or rails running along the center portion of the support member. The truck slides generally linearly along the rail or rails running along the center portion of the support member. The truck also is separately connected to the frame via a linking mechanism, such as a belt that travels through a pulley connected to the actuating member.

In operation, the user stands, sits, kneels or lays on the user support, and engages the actuating member. The actuating member can be adjusted to a comfortable and supportive position. Likewise, any pads and/or braces can be adjusted to a comfortable and supportive position. The user then initiates the exercise, strengthening or rehabilitative motion by moving the actuating member. For certain activities, the actuating member is moved from a first position proximal to the user to a second position distal from the user. For other activities, the actuating member is moved from a first position distal from the user to a second position proximal to the user.

Moving the actuating member causes the actuating member to pivot about the connection between the actuating member and the support member and to be forced either away from the frame or towards the frame. The movement of the actuating member also actuates the linkage mechanism, which in turn acts upon the truck. The truck is pulled along the rail or rails running along the support member in either the same general direction as the movement of the actuating member or in the opposite general direction as the movement of the actuating member. The movement of the truck acts like a wedge between the frame and the support member and forces the frame to pivot about the connection between the frame and the support member. The hinge between the top portion of the truck and the bottom portion of the truck allows the top bearings to maintain smooth contact with the rail or rails running along the bottom side of the frame, and allows the bottom bearings to maintain smooth contact with the rail or rails running along the center portion of the support member.

Weight resistance is provided by the weight of the user, the weight of the frame and the weight of any supplemental resistance weights attached to the machine.

The combined motion of the frame and the actuating member alters the biomechanical movement of the user's body to a composite motion somewhere between linear and a true arc, more closely resembling the accurate biomechanical motion of the human body.

Thus, it is an object of the present invention to provide a composite motion movement machine that allows the user to exercise, strengthen and/or rehabilitate certain muscles in a more biomechanically correct manner.

It is another object of the present invention to provide a composite motion movement machine that efficiently exercises, strengthens, and/or rehabilitates certain muscles.

It is another object of the present invention to provide a composite motion movement machine that causes a reduced amount of stress on certain parts of the user's body that are not the primary focus of the exercise.

These objects, and other objects, features and advantages of the present invention will become more apparent to those of ordinary skill in the art when the following detailed description of the preferred embodiments is read in conjunction with the appended figures.

DETAILED DESCRIPTION OF THE PREFERRED EMBODIMENTS

Figure 1:
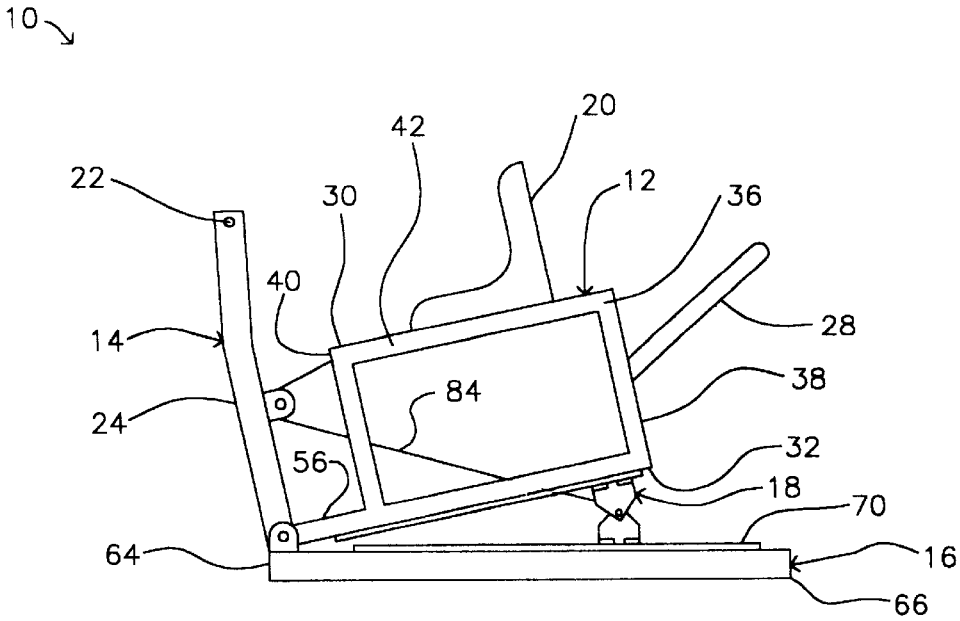
FIG. 1 is a side view of the composite motion movement machine shown in accordance with a first preferred embodiment of the present invention at the first position of the exercise movement.

Referring now to FIGS. 1 through 16, in which like reference numerals represent like components throughout the several views, a composite motion movement machine exercise machine 10 according to a preferred embodiment is shown. Machine 10 comprises both moving user support 20 and moving actuating member 14. User support 20 is mounted on frame 12 that is pivotally connected to support member 16 and that rides upon truck 18. Actuating member 14 also is pivotally connected to support member 16 and also is operatively coupled to truck 18. Truck 18 rides upon base rails 70 that are an integral part of support member 16. Frame 12 further may comprise or may be mechanically coupled to a supplemental weight resistance means 28. FIGS. 1 through 4 and FIG. 16 show a side view of two preferred embodiments of machine 10, which comprises frame 12, actuating member 14, support member 16 and truck 18.

Figure 2:
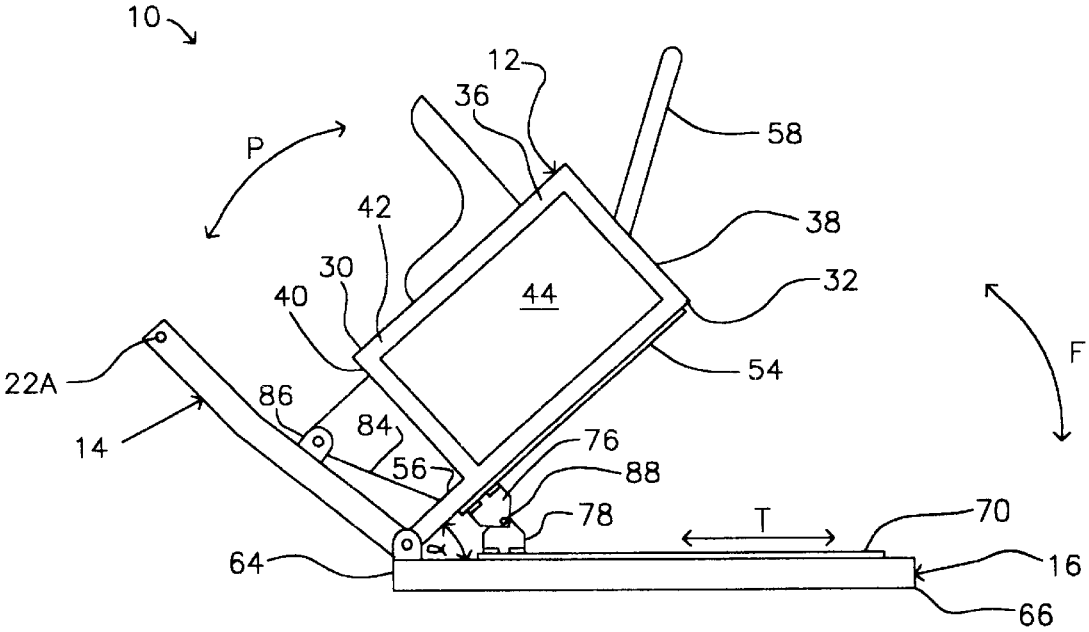
FIG. 2 is a side view of the composite motion movement machine shown in FIG. 1 at the second position of the exercise movement.
Figure 8:
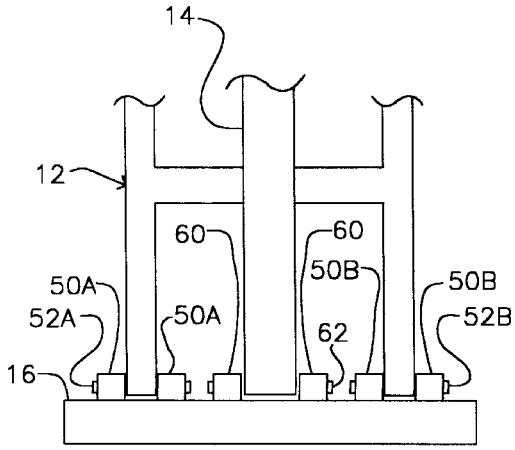
FIG. 8 is a front view of the composite motion movement machine exercise machine shown in FIG. 1.
Figure 16:
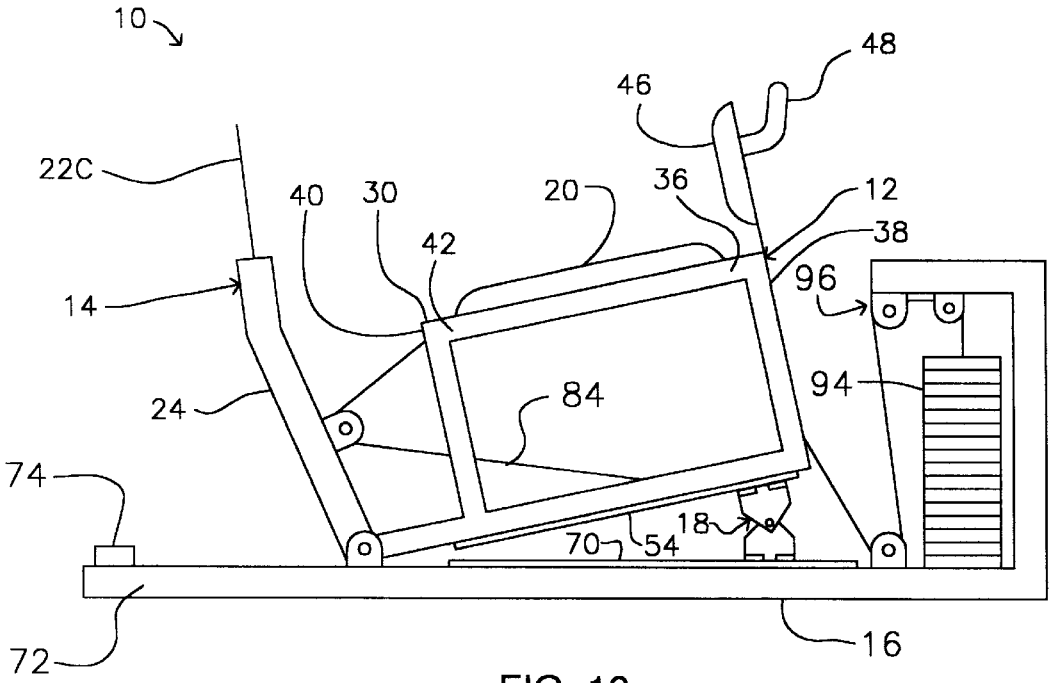
FIG. 16 is a side view of the composite motion movement machine shown in accordance with several combined alternate embodiments of the present invention at the first position of the exercise movement.

Referring now to FIGS. 1, 2 and 8, frame 12 comprises top side 30, bottom side, 32, left side 34, right side 36, back end 38 and front end 40. Frame 12 preferably is made of a number of heavy duty steel tubing sections 42 welded or bolted together to form the desired structure. Panels 44 can be inserted between adjacent sections 42 to form the respective sides. User support 20 is located on top side 30 and is structured and oriented according to the specific type of exercise or physical therapy machine. Certain machines will have a user support 20 on which the user will stand (not shown), others on which the user will sit as shown in FIG. 1, and still others on which the user will lay as shown in FIG. 16.

Frame 12 is pivotally coupled to support member 16 at front end 40 using frame rods 50 journaled into frame bearings 52. As shown in FIGS. 1 and 2, the sections 42 making up bottom side 32 can be elongated in the direction of front end 40. As shown in more detail in FIG. 8, elongated sections 56 can provide the pivotal connection between frame 12 and support member 16 using frame rods 50 and frame bearings 52. Frame 12 pivots relative to support member 16 from a first position shown in FIGS. 1 and 3 to a second position shown in FIGS. 2 and 4. Frame 12 travels in arcuate path F about the centerline between frame bearings 52.

Running along bottom side 32 of frame 12 from proximal to back end 38 to proximal to front end 40 are frame rails 54 for engaging truck 18. Rails 54 preferably are elongated steel cylinders securely attached to bottom side 32. If two rails 54 are used, one rail 54 is located on bottom side 32 proximal to left side 34, and another rail 54 is located on bottom side 32 proximal to right side 36.

Supplemental weight resistance means 28 can be coupled to frame 12 preferably at back end 38. As shown in FIGS. 1 through 4, supplemental weight resistance means 28 can be free weight support rods 58 extending outwardly from back end 38. Alternatively, free weight support rods 58 may extend outwardly from left side and right side instead of or in addition to from back end 38. Although two free weight support rods 58 are shown, the number of free weight support rods is variable. There are many alternatives for supplemental weight resistance means 28 including linkages to weight stacks 94 as shown in FIG. 16, air resistance devices (not shown), elastomeric or tension devices (not shown), compression devices (not shown), gas cylinders (not shown), and hydraulic cylinders (not shown).

Actuating member 14 is located proximal to front end 40 of frame 12 and is pivotally coupled to support member 16. Preferably, actuating member 14 is coupled to support member 16 at a location proximal to where frame 12 is coupled to support member 16. Actuating member 14 comprises actuator 22 and support bar 24 for supporting actuator 22 on support member 16 and for coupling actuating member 14 to truck 18. Actuating member 14 pivots generally in arcuate path P relative to support member 16. Actuator 22 can be adjustable relative to support bar 24 based on the size of the user. As shown in FIGS. 1 through 4, actuator 22 is a hand grip. As shown in FIG. 16, actuator 22 is a push plate. As shown in FIGS. 1 and 2, support bar 24 can be an angled component. This is for practical purposes in that the angle allows more range of motion for the exercise. Additionally, the angle in support bar 24 can provide additional room between frame 12 and actuating member 14 to accommodate both the user and the pulley system described later. Alternatively, support bar 24 can be straight or curved.

Actuating member 14 is pivotally coupled to support member 16 using member rods 60 journaled into member bearings 62. As shown in more detail in FIGS. 8 through 13, the lower end of support bar 24 provides the pivotal connection between actuating member 14 and support member 16 using member rods 60 and member bearings 62. Actuating member 14 pivots relative to support member 16 from a first position shown in FIGS. 1 and 3 to a second position shown in FIGS. 2 and 4. Actuating member 14 travels in arcuate path P about the centerline between member bearings 62.

Figure 3:
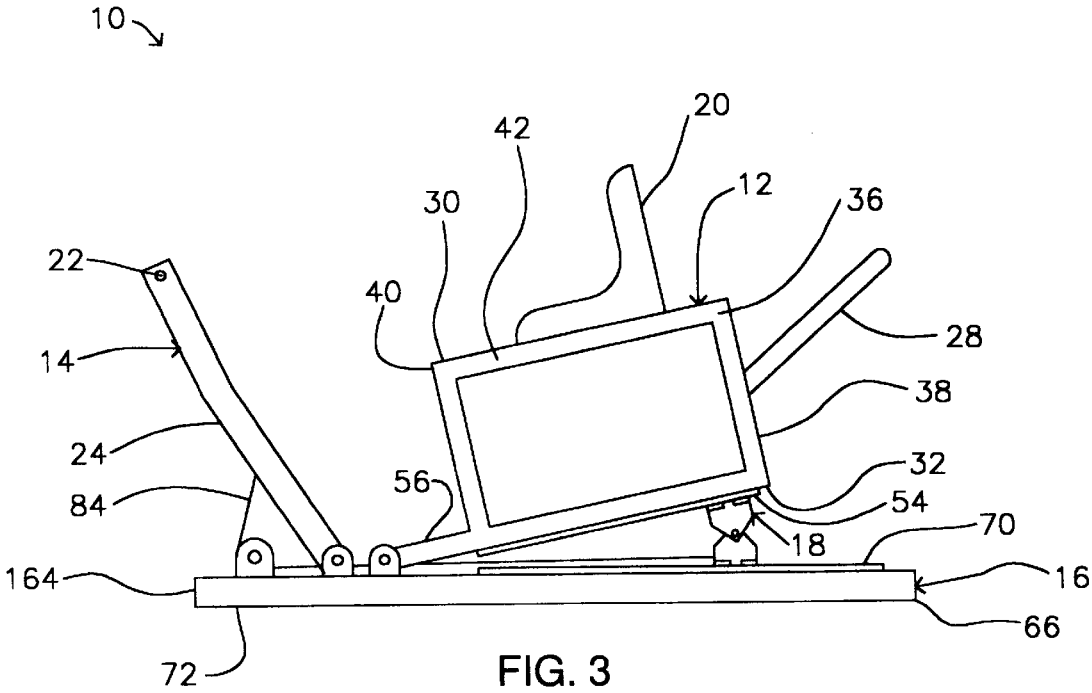
FIG. 3 is a side view of the composite motion movement machine shown in accordance with a second preferred embodiment of the present invention at the first position of the exercise movement.
Figure 4:
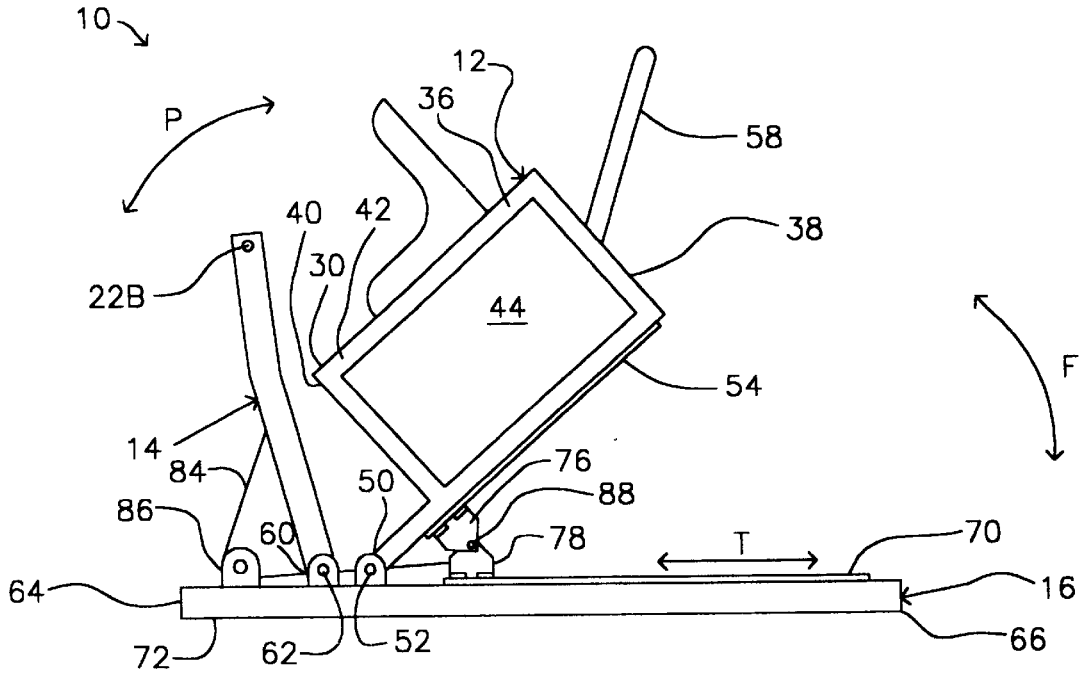
FIG. 4 is a side view of the composite motion movement machine shown in FIG. 3 at the second position of the exercise movement.

Actuating member 14 can be coupled to support member 16 at various locations depending on the type of exercise for which machine 10 is designed. As shown in FIGS. 1 and 2, frame rod 52 and member rod 62 are coaxial and frame bearings 50 and member bearings 60 are coaxial. In this embodiment, frame 12 and actuating member 14 are mounted collinear and coaxial to each other. As shown in FIGS. 3 and 4, frame rod 52 and member rod 62 are not coaxial and frame bearings 50 and member bearings 60 are not coaxial. In this embodiment, frame 12 and actuating member 14 are not mounted collinear or coaxial to each other, with actuating member 14 being mounted on support member 16 at a position outside of elongated sections 56. As shown in FIG. 16, frame rod 52 and member rod 62 are not coaxial and frame bearings 50 and member bearings 60 are not coaxial. In this embodiment, frame 12 and actuating member 14 are not mounted collinear or coaxial to each other, with actuating member 14 being mounted on support member 16 at a position inside of elongated sections 56.

Actuator 22 is a generic term for the operative interface between machine 10 and the user. For example as shown in FIGS. 1 and 2, if machine 10 is a chest press, actuator 22 would be either pads on which the user would place his or her hands, or grips 22A that the user would grab with his or her hands and push to actuate. For another example as shown in FIGS. 3 and 4, if machine 10 is a lat pull, actuator 22 would be grips 22B that the user would grab with his or her hands and pull to actuate. For another example as shown in FIG. 16, if machine 10 is a leg press, actuator 22 would be a push plate 22C on which the user would place his or her feet and push to actuate. For another example (not shown), if machine 10 is a leg curl, actuator 22 would be roller pads that the user would engage with his or her ankles or calves.

Support member 16 generally is a component that lays flat on the floor or other supporting surface. Frame 12 and actuating member 14 are pivotally connected on or near a first side or edge 64 of support member 16. Both first side 64 and second side or edge 66 of support member 16 provide stability for the machine 10. One or more base rail 70 for carrying truck 18 is or is located along a portion of the center portion 68 of support member 16. Base rail preferably extends generally along the length of center portion 68 of support member 16 directly underneath frame 12.

As shown in more detail in FIGS. 8 through 13, frame bearings 50 and member bearings 60 are mounted on first side 64 of support member 16. In a preferred embodiment, the centerlines of frame bearings 50 and member bearings 60 are collinear, allowing both frame 12 and actuating member 14 to pivot about the same axis. Support member 16 also may have extension 72 extending from first side 64 collinearly with center portion 68. As an alternative, member bearings 60 may be located on extension 72. In this situation, the centerlines of frame bearings 50 and member bearings 60 are not collinear, and frame 12 and actuating member 14 do not pivot about the same axis. Additionally, extension 72 can comprise actuating member stop 74 for delineating the farthest extent actuating member 14 may travel.

Figure 9:
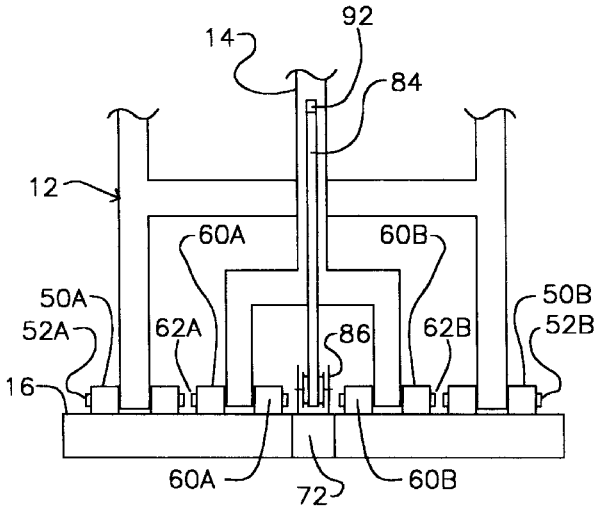
FIG. 9 is a front view of a first alternate embodiment of the composite motion movement machine exercise machine shown in FIG. 1.

FIGS. 8 through 13 also show several alternate embodiments of the structure of frame 12 and actuating member 14, and the connections between frame 12, actuating member 14, and support member 16. FIG. 8 shows a wide box-like frame 12 supported on support member 16 at two points. Each support point has its own set of frame bearings 50A, 50B and its own frame rod 52A, 52B. Actuating member 14 is supported at one point between frame 12 support points with its own member bearings 60 and member rod 62. This embodiment is useful for machines 10 on which the user pushes actuating member 14. The wide box-like frame 12 is preferred for machines 10 on which the user lays. FIG. 9 shows a wide box-like frame 12 supported on support member 16 at two points. Each support point has its own set of frame bearings 50A, 50B and its own frame rod 52A, 52B. Actuating member 14 has an arched base 15 and is supported at two points between frame 12 support points with its own member bearings 60A, 60B and member rods 62A, 62B. This embodiment is useful for machines 10 both on which the user pushes actuating member 14 and on which the user pulls actuating member 14 as actuating member 14 comprises an arch 15 through which belt 84 can pass.

Figure 10:
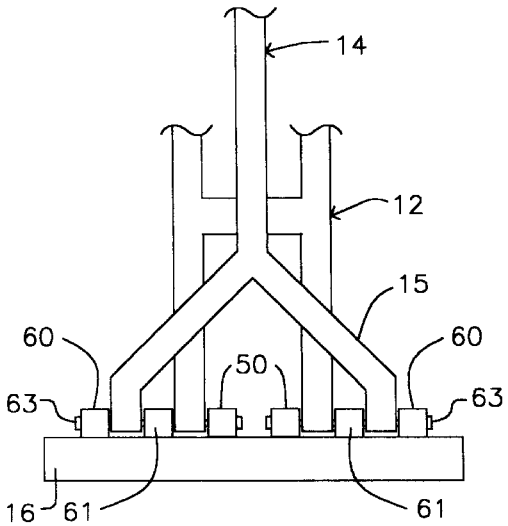
FIG. 10 is a front view of a second alternate embodiment of the composite motion movement machine exercise machine shown in FIG. 1.
Figure 11:
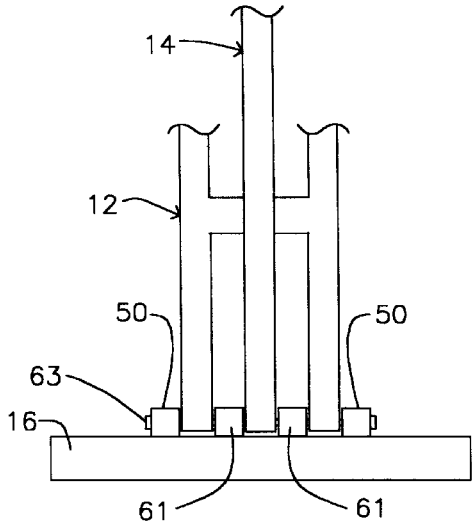
FIG. 11 is a front view of a third alternate embodiment of the composite motion movement machine exercise machine shown in FIG. 1.

FIG. 10 shows a narrow box-like frame 12 supported on support member 16 at two points. Each support point has its own frame bearing 50. Actuating member 14 has an arched base 15 and is supported at two points outside of frame 12 support points with its own member bearing 60. In this embodiment, frame 12 and actuating member share central bearings 61 and pivot rods 63. This embodiment is useful for machines 10 both on which the user pushes actuating member 14 and on which the user pulls the actuating member 14 as actuating member 14 comprises an arch 15 through which belt 84 can pass. The narrow box-like frame 12 is preferred for machines 10 on which the user kneels or sits. FIG. 11 shows a narrow box-like frame 12 supported on support member 16 at two points. Each support point has its own frame bearing 50. Actuating member 14 is supported at one point between frame 12 support points. In this embodiment, frame 12 and actuating member share central bearings 61 and a single pivot rod 63 and provide a relatively compact footprint. This embodiment is useful for machines 10 on which the user pushes actuating member 14.

Figure 12:
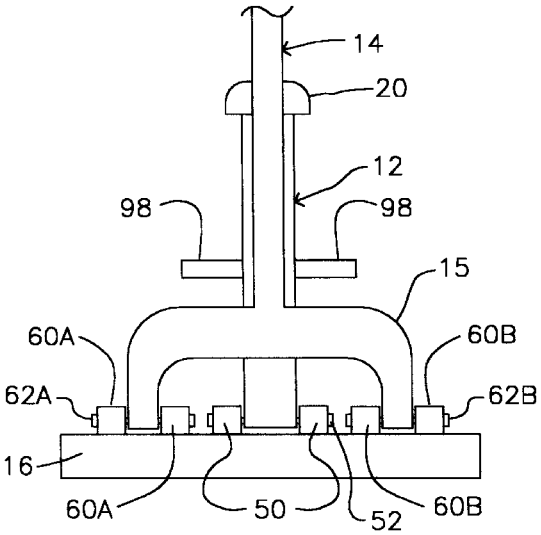
FIG. 12 is a front view of a fourth alternate embodiment of the composite motion movement machine exercise machine shown in FIG. 1.
Figure 13:
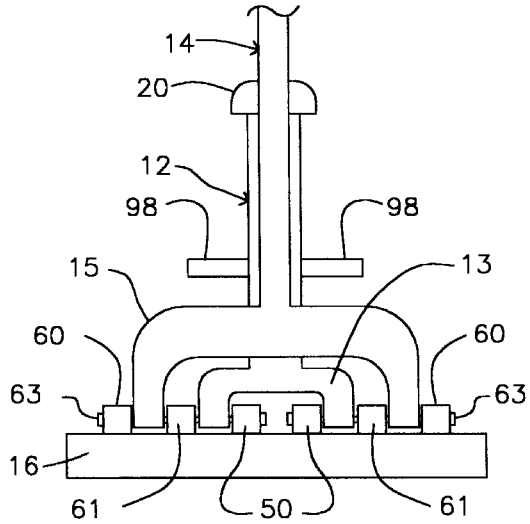
FIG. 13 is a front view of a fifth alternate embodiment of the composite motion movement machine exercise machine shown in FIG. 1.
Figure 15:
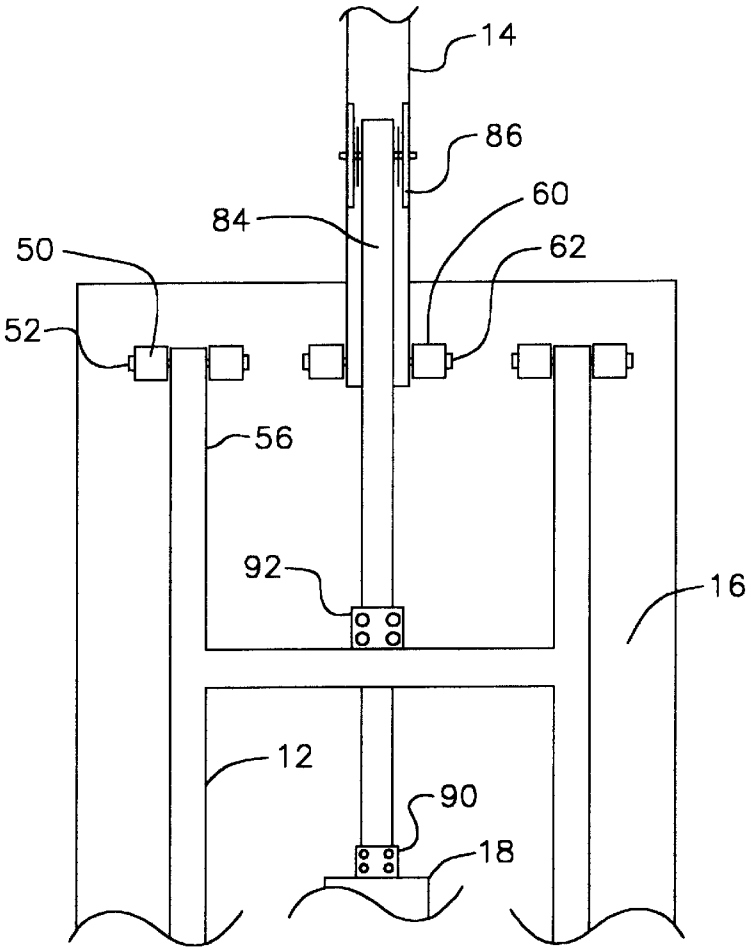
FIG. 15 is a view of the drive mechanism for the composite motion movement machine exercise machine shown in FIG. 1.
Figure 14:
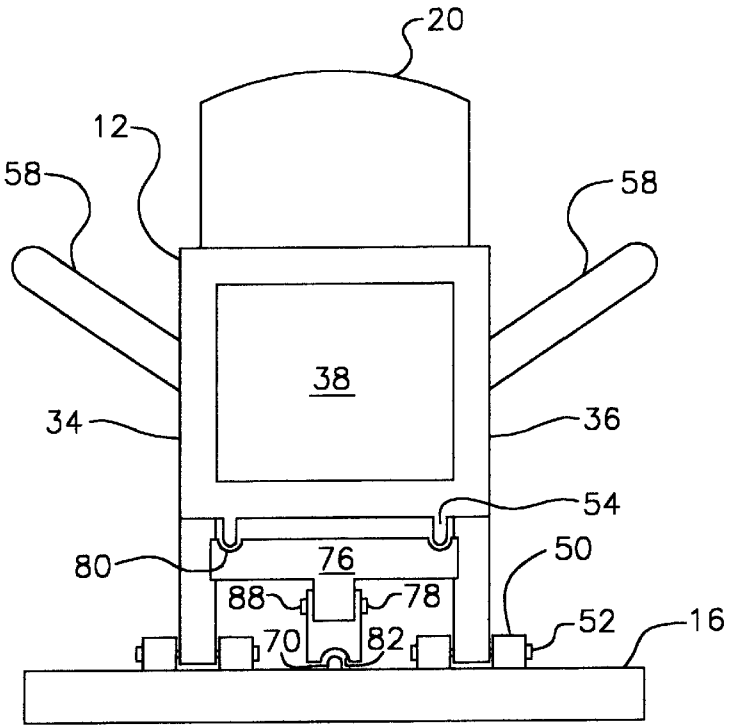
FIG. 14 is a rear view of the composite motion movement machine exercise machine shown in FIG. 1.

FIG. 12 shows a linear frame 12 supported on support member 16 at one point. The support point has its own frame bearings 50 and frame rod 52. Actuating member 14 has an arched base 15 and is supported at two points outside of frame 12 support points with its own member bearings 60 and member rods 62. This embodiment is useful for machines 10 on which the user pushes actuating member 14. The linear frame 12 is preferred for machines on which the user sits. FIG. 13 shows a linear frame 12 that has an arched base 13 and is supported on support member 16 at two points. Each support point has its own frame bearing 50. Actuating member 14 has an arched base 15 and is supported at two points outside of frame 12 support points with its own member bearing 60. In this embodiment, frame 12 and actuating member share central bearings 61 and pivot rods 63. This embodiment is useful for machines 10 both on which the user pushes actuating member 14 and on which the user pulls the actuating member 14 as actuating member 14 comprises an arch 15 through which belt 84 can pass. In this embodiment, actuating member 14 alternatively can be supported at two points between frame 12 support points simply by decreasing the size of arched base 15 and increasing the size of arch 13. FIGS. 12 and 13 also show foot rests 98.

Figure 5:
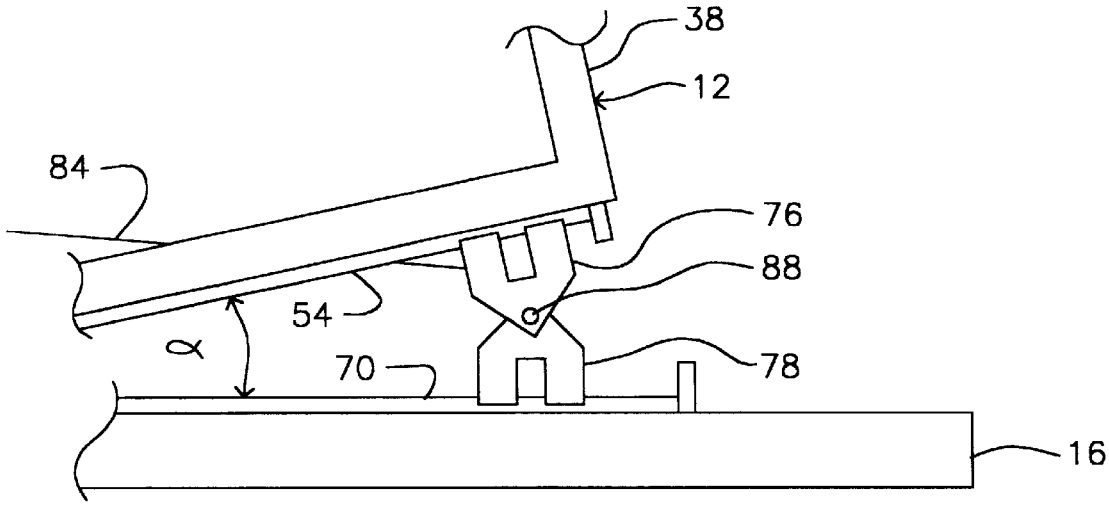
FIG. 5 is a side view of the support truck of the composite motion movement machine shown in FIG. 1 and FIG. 3 at the first position of the exercise movement.
Figure 6:
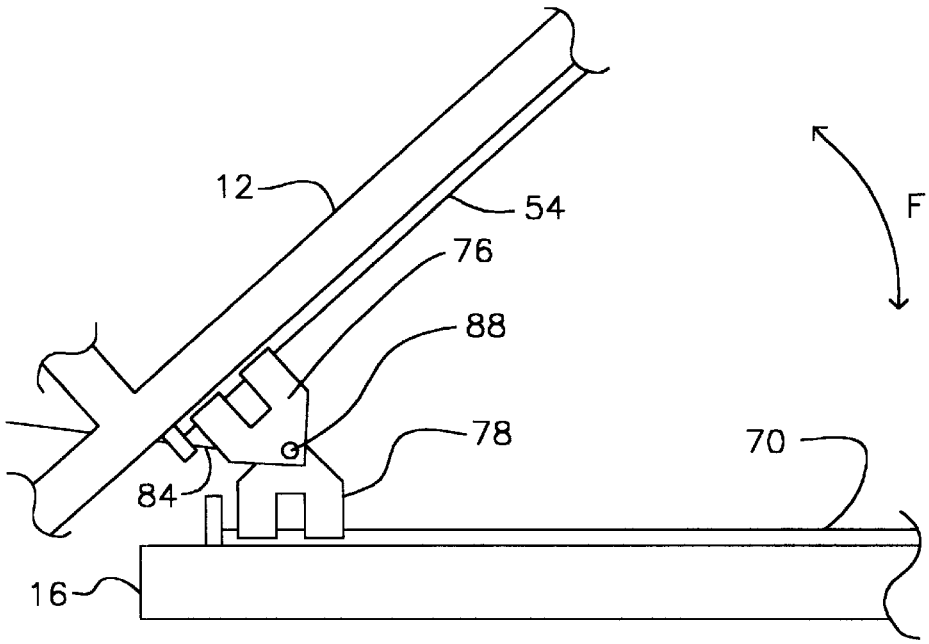
FIG. 6 is a side view of the support truck of the composite motion movement machine shown in FIG. 1 and FIG. 3 at the second position of the exercise movement.
Figure 7:
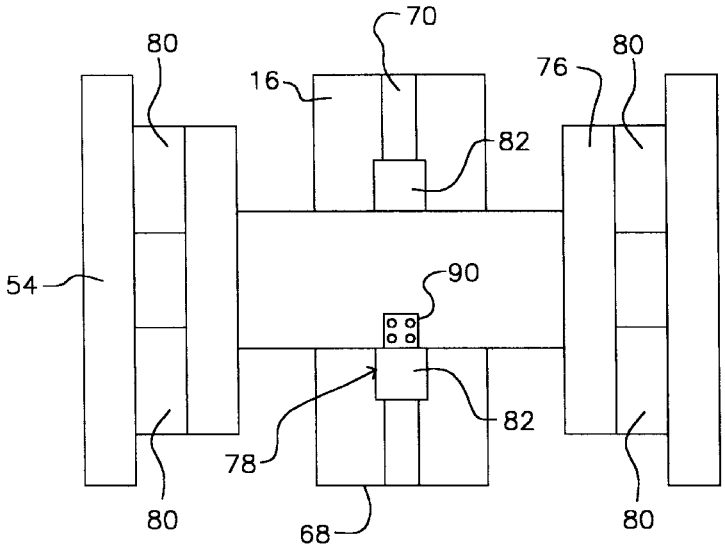
FIG. 7 is a top view of the support truck of the composite motion movement machine exercise machine shown in FIG. 1.

Truck 18 is located between frame 12 and support member 16 and is slidably connected to frame 12 by frame rails 54 and to support member 16 by base rail 70. As shown in more detail in FIGS. 5 through 7, truck 18 is a hinged component comprising a top portion 76 pivotally hinged to a bottom portion 78. Frame or top bearings 80 located on top portion 76 of truck 18 cooperate with frame rails 54 running along bottom side 32 of frame 18, and base or bottom bearings 82 located on bottom portion 78 of truck 18 cooperate with base rail 70 running along center portion 68 of support member 16. Truck 18 slides generally linearly along path T along base rail 70 from a first position as shown in FIGS. 1, 3 and 5 to a second position as shown in FIGS. 2, 4 and 6. As shown in FIGS. 1 and 2, in a first embodiment preferred for machines 10 on which the user pushes actuating member 14, truck 18 also is separately connected to frame 12 by a linking mechanism, such as belt 84 that travels through pulley 86 connected to support bar 24 of actuating member 14. As shown in FIGS. 3 and 4, in a second preferred embodiment preferred for machines 10 on which the user pulls actuating member 14, truck is connected to actuating member 14 by a linking mechanism, such as belt 84 that travels though pulley 86 connected to extension 72

As truck 18 is pulled along path T by the movement of actuating member 14, truck 18 acts analogously to a wedge between frame 12 and support member 16. When force is applied to actuator 22, either by pushing or pulling, truck 18 is pulled by actuating member 14 from the first position shown in FIGS. 1, 3 and 5 to the second position shown in FIGS. 2, 4 and 6 forcing frame 12 to pivot upwards along path F. When force is removed from actuator 22, truck 18 is forced by the weight of frame 12, as well as the weight of the user and any resistance weights coupled with frame 12, from the second position shown in FIGS. 2, 4 and 6 to the first position shown in FIGS. 1, 3 and 5. As frame 12 pivots relative to support member 16, the angle $\alpha$ between frame 12 and support member 16 changes. Hinge 88 allows top portion 76 to rotate relative to bottom portion 78 as truck 18 moves from the first position to the second position such that the angle between top portion 76 and bottom portion 78 matches angle $\alpha$.

Truck 18 is operatively coupled to actuating member 14. In a first preferred embodiment shown in FIGS. 1 and 2, truck 18 is coupled directly to frame 12 and coupled indirectly to actuating member 14. In a second preferred embodiment shown in FIGS. 3 and 4, truck 18 is coupled directly to actuating member 14. The preferred coupling mechanism is shown in more detail in FIGS. 7, 9 and 15. In the first preferred embodiment shown in FIGS. 1 and 2, a first end of belt 84 is securely attached to truck 18, preferably with a first clamp 90. Belt 84 then passes over pulley 86 that is mounted on actuating member 14, preferably on support bar 24. A second end of belt 84 is securely attached to frame 12, preferably with a second clamp 92. In the second preferred embodiment shown in FIGS. 3 and 4, a first end of belt 84 is securely attached to truck 18, preferably with a first clamp 90. Belt 84 then passes over pulley 86 that is mounted on extension 72. A second end of belt 84 is securely attached to actuating member 14, preferably with a second clamp 92. Both clamps 90, 92 can be pivotally connected to truck 18 and actuating member 14, respectively, such that as machine 10 moves through its range of motion, belt 84 and clamps 90, 92 can pivot, reducing stress on belt 84.

In the first preferred embodiment shown in FIGS. 1 and 2, moving actuating member 14 away from frame 12 causes tension in belt 84, pulling truck 18 along path T towards actuating member 14. Additionally, moving actuating member 14 away from frame 12 causes tension in belt 84, pulling frame 12. The combined pulling of truck 18 and frame 12 causes frame 12 to rotate about path F. In the second preferred embodiment shown in FIGS. 3 and 4, moving actuating member 14 toward frame 12 causes tension in belt 84, pulling truck 18 along path T towards actuating member 14. The pulling of truck 18 causes frame 12 to rotate about path F.

Although a belt and pulley linking mechanism is described as the preferred embodiment, alternatives are suitable. For example, the belt can be of any known structure, such as steel cables, wound cables, wire, polymer tows, carbon fiber, tension devices, bar linkages, and elastomers. Likewise, the pulley can be any direction changing device, such as gears, Teflon® or other slippery material rods, and elbow-shaped components.

The linking mechanism also can be designed to have a variable stroke ratio between actuating member 14 and truck 18. For example, a direct link between actuating member 14 and truck 18 typically results in an actuating member 14 to truck 18 stroke ratio of approximately 1:1 where a 1 inch movement of actuating member 14 results in a one inch movement of truck 18. The direct link ratio may not be exactly 1:1 because actuating member 14 travels in an arcuate path while truck 18 travels in a linear path, but for example purposes a direct link will be defined as having a 1:1 stroke ratio. The use of one or more cams, pulleys, reduction gears, increases gears, and/or the like, as well as combinations of these components, can alter the stroke ratio. For example, with an actuating member 14 to truck 18 stroke ratio of 1:5, a one inch movement of actuating member 14 results in a five inch movement of truck 18, and with an actuating member 14 to truck 18 stroke ratio of 5:1, a five inch movement of actuating member 14 results in a one inch movement of truck 18. Varying the stroke ratio varies the force needed to complete the operative movement of machine 10, resulting in different levels of exercise, strengthening, or rehabilitation.

Several alternatives for machine 10 are shown in a combined view in FIG. 16. FIG. 16 exemplifies a leg press type of machine 10 having a supine user support 20 with shoulder pads 46 and support grips 48. The user lays on user support 20 and places his or her feet on push plate actuator 22 to activate machine 10. Extension 72 can have stop 74 that limits the forward travel of actuating member 14. Frame 12 is connected to weight stack 94 by a cable and pulley system 96. Frame 12 also is somewhat elongated compared to frame 12 shown in FIG. 1 to accommodate supine user support 20, which typically is longer than standing, sitting or kneeling user support 20.

In operation, the user stands, sits, kneels or lays on user support 20 and engages actuator 22. Actuator 22, if adjustable, can be adjusted relative to support bar 24 so that the user is comfortable and in the proper position for the exercise, strengthening or rehabilitation motion. Pads 46 and/or support grips 48, if present, can be adjusted relative to user support 20 to a proper position for comfort and/or exercise, strengthening or rehabilitation motion. The user then initiates the exercise, strengthening or rehabilitation motion by applying force to actuator 22, generally either by pushing or pulling movements, and thus moving actuating member 14 from the first position to the second position.

The exercise, strengthening or rehabilitation motion causes several actions. Moving actuator 22 causes actuating member 14 to pivot about the connection between support bar 24 and support member 16 and to be forced away from or toward frame 12, as the case may be. In the first preferred embodiment, the movement of actuating member 14 also moves pulley 86, which is attached to support bar 24, and acts upon belt 84 connecting truck 18 to frame 12 and traveling through pulley 86. Truck 18 is pulled along the base rail 70 running along center portion 68 of support member 16 in the same general direction T as the movement P of actuating member 14. In the second preferred embodiment, the movement of actuating member 14 acts upon belt 84 traveling through pulley 86 and connecting truck 18 to actuating member 14. Truck 18 is pulled along the base rail 70 running along center portion 68 of support member 16 in the opposite general direction T as the movement P of actuating member 14.

In both preferred embodiments, the movement T of truck 18 acts analogously to a wedge between frame 12 and support member 16 and forces frame 12 to pivot about the connection between frame 12 and support member 16, and back end 38 of frame 12 moves along path F. Further, in the first preferred embodiment, because belt 84 preferably is connected to frame 12, the action of pushing actuating member 14 assists in causing frame 12 to travel in arcuate path F. Hinge 88 between top portion 76 of truck 18 and bottom portion 78 of truck 18 allows top bearings 80 to maintain smooth contact with frame rails 54 running along bottom side 32 of frame 12, and allows bottom bearings 82 to maintain smooth contact with the base rail 70 running along center portion 68 of support member 16.

Various supplemental weight resistance means 28 can be used to provide resistance weight for the machine 10. If the user so chooses, the user does not have to add any supplemental weight resistance means 28 to the machine 10 and in this situation the resistive force will be the weight of frame 12 and the weight of the user. The user can place free weights on free weight support rods 58 to increase the resistive force. In an alternative embodiment, a weight stack 94 as shown in FIG. 16 or other supplemental weight resistance means 28 is attached to the machine 10, by cables, linkages or other coupling means.

An optional locking mechanism (not shown) can be included on machine 10. Preferably, locking mechanism holds machine at an intermediate position between the first position as shown in FIGS. 1 and 3 and the second position as shown in FIGS. 2 and 4. Such a locking mechanism is for convenience reasons. By holding machine 10 in an intermediate position, ingress and egress to machine by the user is simplified, adding to the convenience of machine.

The combined motion, or composite motion movement, of user support 20 and actuating member 14 alters the biomechanical movement of the user's body to a composite motion somewhere between linear and a true arc, more closely resembling the accurate biomechanical motion of the human body.

While the invention has been described in connection with certain preferred embodiments, it is not intended to limit the spirit or scope of the invention to the particular forms set forth, but is intended to cover such alternatives, modifications, and equivalents as may be included within the true spirit and scope of the invention as defined by the appended claims.

What is claimed is:

1. A composite motion movement machine, comprising:

a. a support member;

b. a user support frame pivotally connected to said support member;

c. a truck in slidable engagement with said support member and said frame;

d. an actuating member pivotally connected to said support member, said actuating member being adapted to move between a first position and a second position; and e. a linking mechanism operatively coupling said actuating member with said truck;

wherein, when said actuating member moves between said first position and said second position, said truck moves forcing said frame to pivot relative to said support member.

2. The exercise apparatus characterized in claim 1, wherein said frame comprises at least one frame rail and said truck comprises at least one frame bearing that acts in cooperation with said frame rail.

3. The exercise apparatus characterized in claim 1, wherein said support member comprises at least one base rail and said truck comprises at least one base bearing that acts in cooperation with said base rail.

4. The exercise apparatus characterized in claim 1, wherein said truck comprises a top portion that cooperates with said frame, a bottom portion that cooperates with said support member, and a hinge portion that hingedly connects said top portion to said bottom portion.

5. The exercise apparatus characterized in claim 1, wherein said frame is pivotable in an arcuate path, said actuating member is pivotable in an arcuate path, and said truck is slidable in a linear path.

6. The exercise apparatus characterized in claim 5, wherein said frame, said actuating member, and said truck are all in operative engagement with each other.

7. The exercise apparatus characterized in claim 6, wherein said frame pivots about a first pivot axis and said actuating member pivots about a second pivot axis.

8. The exercise apparatus characterized in claim 7, wherein said first pivot axis and said second pivot axis are collinear.

9. The exercise apparatus characterized in claim 7, wherein said first pivot axis and said second pivot axis are parallel.

10. The exercise apparatus characterized in claim 1, further comprising a resistance weight.

11. The exercise apparatus characterized in claim 10, wherein said resistance weight is selected from the group consisting of free weights and weight stacks.

12. The exercise apparatus characterized in claim 1, wherein said linking mechanism comprises a belt and a pulley.

13. The exercise apparatus characterized in claim 12, wherein said belt comprises a first end attached to said truck and a second end attached to said frame.

14. The exercise apparatus characterized in claim 12, wherein said belt comprises a first end attached to said truck and a second end attached to said actuating member.

15. The exercise apparatus characterized in claim 1, wherein said actuating member is height adjustable relative to said frame.

16. The exercise apparatus characterized in claim 1, further comprising a lock for locking said frame, said actuating member, and said truck at an intermediate position between the starting position and the ending position.

17. The exercise apparatus characterized in claim 1, wherein said user support frame is adjustable.

* * * * *